US008585480B2

(12) United States Patent
Wang

(10) Patent No.: US 8,585,480 B2
(45) Date of Patent: Nov. 19, 2013

(54) SHOVE BOARD GAME SYSTEM AND PLAYING METHOD THEREOF

(76) Inventor: Chien-Yu Wang, Taipei (TW)

( * ) Notice: Subject to any disclaimer, the term of this patent is extended or adjusted under 35 U.S.C. 154(b) by 1489 days.

(21) Appl. No.: 12/196,472

(22) Filed: Aug. 22, 2008

(65) Prior Publication Data

US 2010/0048276 A1 Feb. 25, 2010

(51) Int. Cl.
*A63F 13/00* (2006.01)
*A63F 3/00* (2006.01)

(52) U.S. Cl.
USPC ..... 463/14; 463/9; 273/236; 273/242; 273/260; 273/261

(58) Field of Classification Search
USPC ..... 463/1, 9, 14; 273/236, 242, 261
See application file for complete search history.

(56) References Cited

U.S. PATENT DOCUMENTS

2003/0109310 A1 * 6/2003 Heaton et al. ..... 463/42

FOREIGN PATENT DOCUMENTS

TW 368892 U1 * 9/1999

OTHER PUBLICATIONS http://www.clickhere.nl/abalone (Abalone: the game of marbles), 1 page.

* cited by examiner

*Primary Examiner* — Dmitry Suhol
*Assistant Examiner* — Andrew Kim
(74) *Attorney, Agent, or Firm* — Muncy, Geissler, Olds & Lowe, PLLC

(57) ABSTRACT

A shove board game system and playing method thereof includes: a game host to process a shove board game program and provide a picture of a chessboard and an information window and reset status of all pieces on the chessboard, a display device communicating with the game host to display the chessboard, pieces and the information window and related information, and an input device communicating with the game host to receive operations of players to proceed the shove board game. The chessboard is octagonal and has multiple longitudinal and transverse lines in directions of X and Y axes and diagonal straight lines formed at an angle of 45 degrees against the X and Y axes. The lines cross one another to form points of intersection. The pieces are positioned on the points of intersection.

10 Claims, 14 Drawing Sheets

SHOVE BOARD GAME SYSTEM AND PLAYING METHOD THEREOF

FIELD OF THE INVENTION

The present invention relates to an electronic game system and a playing method thereof and particularly to a shove board game system and a playing method thereof.

BACKGROUND OF THE INVENTION

Chess and board games are known in the art. One example is U.S. Pat. No. 6,981,700B2 entitled "Strategic board game" which has a plurality of spaces formed on a chessboard to hold pieces of different strengths. An active player can move (push or pull) or freeze the pieces of an opponent with a piece of a higher strength, or eject an opponent's piece fallen in a trap space, and move his/her pieces of a lower strength to the most remote location of the active player's own side (namely opponent's border) to win the game.

Another example of intelligent board game is called "Abalone". Some Web sites offer downloading of the game, such as http://www.clickhere.nl/abalone/ provides an Abalone game platform for players. Abalone has a hexagonal board (of equal sides) with total sixty one spaces. Each side has five spaces to hold pieces. Two players take turn to play the game. At the start of the game each player has fourteen pieces close to the nearest border of each player's side. The pieces have different colors for two sides (usually black and white). According to the rules of the game, the active player can move from one to three pieces at a time on a straight line or toward one side. Either side can eject the opponent's piece outside the border of the chessboard through superiority in the number of the pieces. In principle, the player who has a greater number of pieces can push the opponent's pieces of a fewer number. And only one piece can be pushed out at a time. The player who first pushes six opponent's pieces out wins the game.

The method of playing Abalone is substantially like that of U.S. Pat. No. 6,981,700 B2. The main difference is the rules of pushing the opponent's pieces. Abalone, like most other board games, allows only two players in a game, and does not allow more than two players to participate in a game at the same time.

SUMMARY OF THE INVENTION

The object of the present invention is to provide a shove board game system that allows minimum one player and maximum four players to participate in a game at the same time.

In an embodiment the shove board game system of the invention includes:

a game host which has a shove board game program resided therein and executes game processing and provide a chessboard for the game;

a display device communicating with the game host to display a picture of the chessboard and an information window; and an input device communicating with the game host to receive operation of players to proceed the game.

Another object of the invention is to provide a method of a shove board game. It includes:

providing a chessboard which is octagonal and has a plurality of longitudinal and transverse straight lines crossing one another with pieces positioned on the points of intersection of the lines and movable on the lines to an adjacent intersection. The lines are formed in the directions of X and Y axes and also in diagonal directions at 45 degrees against X and Y axes;

providing bases to participating players to hold their own pieces;

selecting an active player and taking turn among the players to play a game;

allowing the active player to select at least one, or two or maximum three adjacent pieces on one line as an active moving-designated piece group;

allowing the selected piece or one piece group to move one step in one direction of the same line or towards one side;

moving an opponent's pieces for one step in the moving direction of the moving-designated piece group in the event that the number of opponent's pieces on the same line is fewer than that of the moving-designated piece group;

giving opponent's pieces ejected outside a chessboard border to the active player; and admitting a loser for the player who has remained pieces fewer than one half of total pieces owned by the player when the game started.

According to an embodiment the method of the invention further includes:

giving the remained pieces of the loser to the player who gains most pieces of the loser in the game of three or more players;

Yet another object of the invention is to provide a shove board game system that allows a first player to join a second player to shove pieces of other players.

In one aspect, total three or more players participate in a game; an active player is allowed to join the pieces of the second player to shove the pieces of the other players; the pieces being ejected in the joined duration belong to the active player who initiates join request.

In another aspect, four players participate in a game and are divided into two rival teams against each other. Each player takes turn in playing. An active player is allowed to join the pieces of (i.e. the teammate) to shove the pieces of the rival team; the pieces being ejected in the joined duration belong to the active player who initiates join request.

According to the invention, one to four players can participate in the game at the same time in the shove board game system and the method thereof. And the players can join strategically and deploy the pieces of other players to win the game. It is more versatile and provides rich diversity than the conventional games.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
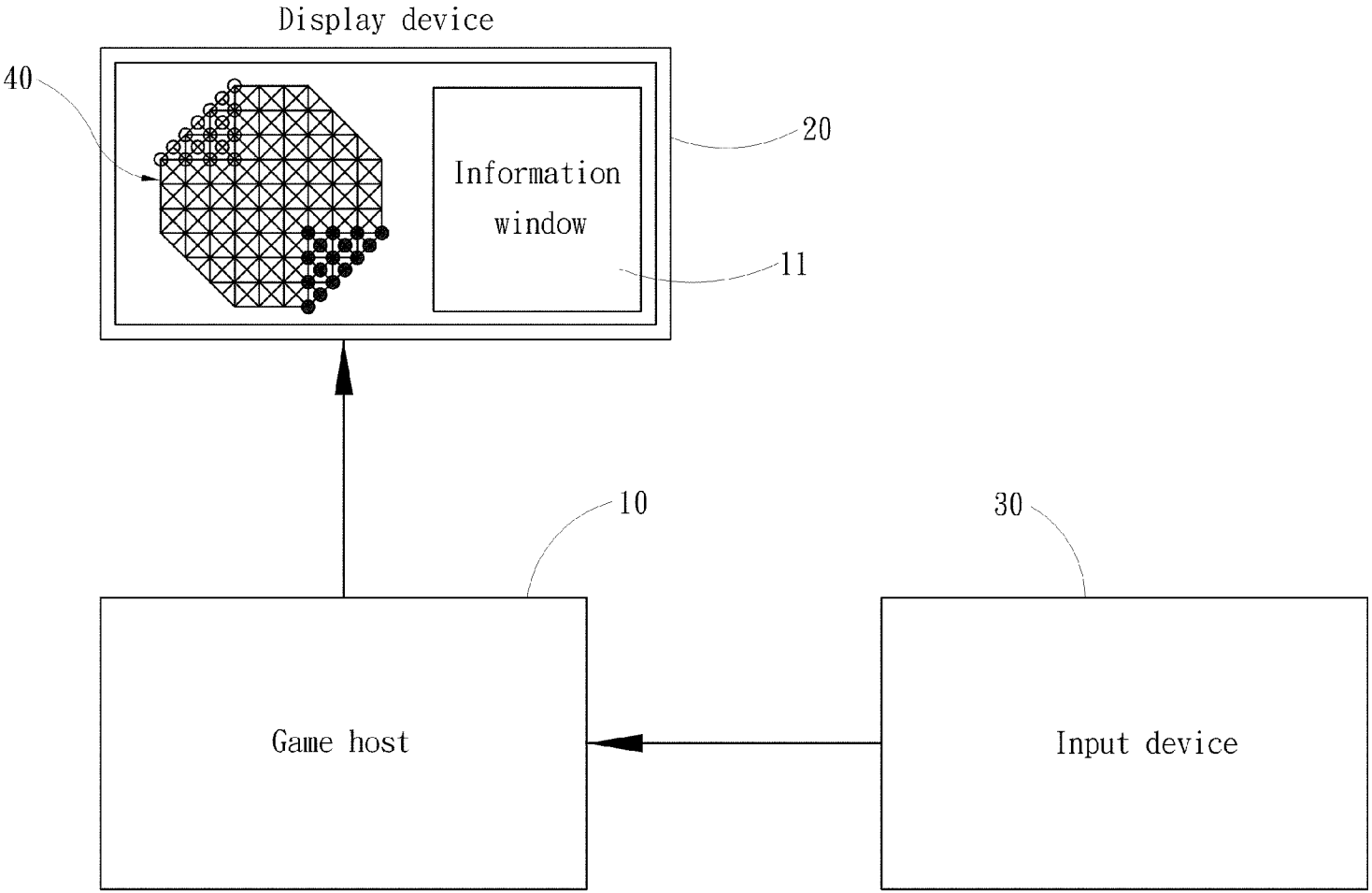
FIG. 1 is a schematic view of the architecture of the shove board game system of the invention.

Please refer to FIG. 1 for the architecture of an embodiment of the shove board game system of the invention. It includes:

a game host 10 which has a shove board game program resided therein and executes the game program, and provides a picture of a chessboard 40 and an information window 11, and resets status of all pieces on the chessboard. The game host 10 may be a personal computer (PC), server or electronic device capable of processing programs;

a display device 20 communicating with the game host 10 to display the chessboard 40 and the information window 11. The information window 11 mainly aims to display related game information during the game process, such as interacting messages among players, scores or gain-piece count information and the like; and an input device 30 communicating with the game host 10 to receive operations of the players to proceed the shove board game.

Figure 2:
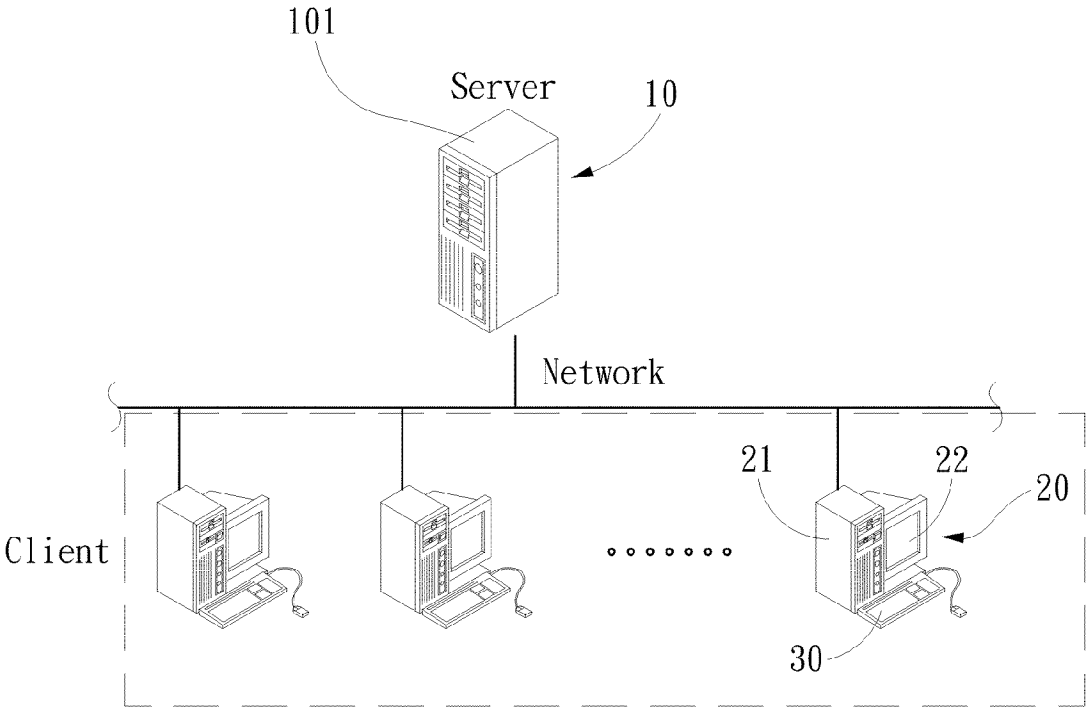
FIG. 2 is a schematic view of an embodiment of the shove board game system of the invention.

Refer to FIG. 2 for an embodiment according to the architecture shown in FIG. 1. The game host 10 is a server 10*a* on a network (such as LAN or the Internet). The display device 20 is a display unit 22 of a client computer 21 (generally a PC, notebook computer or other electronic devices capable of linking to the network and processing programs). The client may be more than one linking to the server 10*a* through the network to play the shove board game independently or with other players through the server 10*a*. During playing the player maneuvers the game through the input device 30 (usually is a keyboard, mouse or a computer peripheral device capable of entering commands) located at the client site. Other input devices such as touch panels capable of displaying and accepting input and electronic devices equipped with the touch panel (such as PDA, mobile phones) also can be used.

Figure 3:
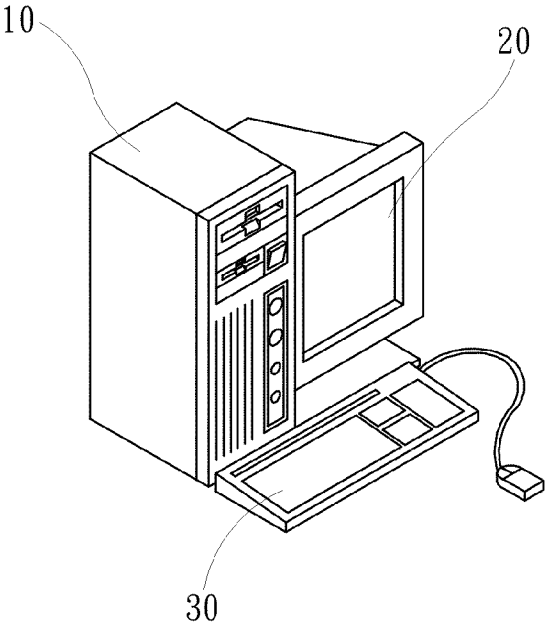
FIG. 3 is a schematic view of another embodiment of the shove board game system of the invention.

Refer to FIG. 3 for another embodiment according to the architecture shown in FIG. 1. It is a standalone game player. The game host 10 may be a PC, notebook computer or other electronic devices capable of processing programs (such as PDA, mobile phones). The game host 10 is connected to the display device 20 and input device, thus allows players to play the shove board game directly with the host 10 without networking capability.

Figure 4:
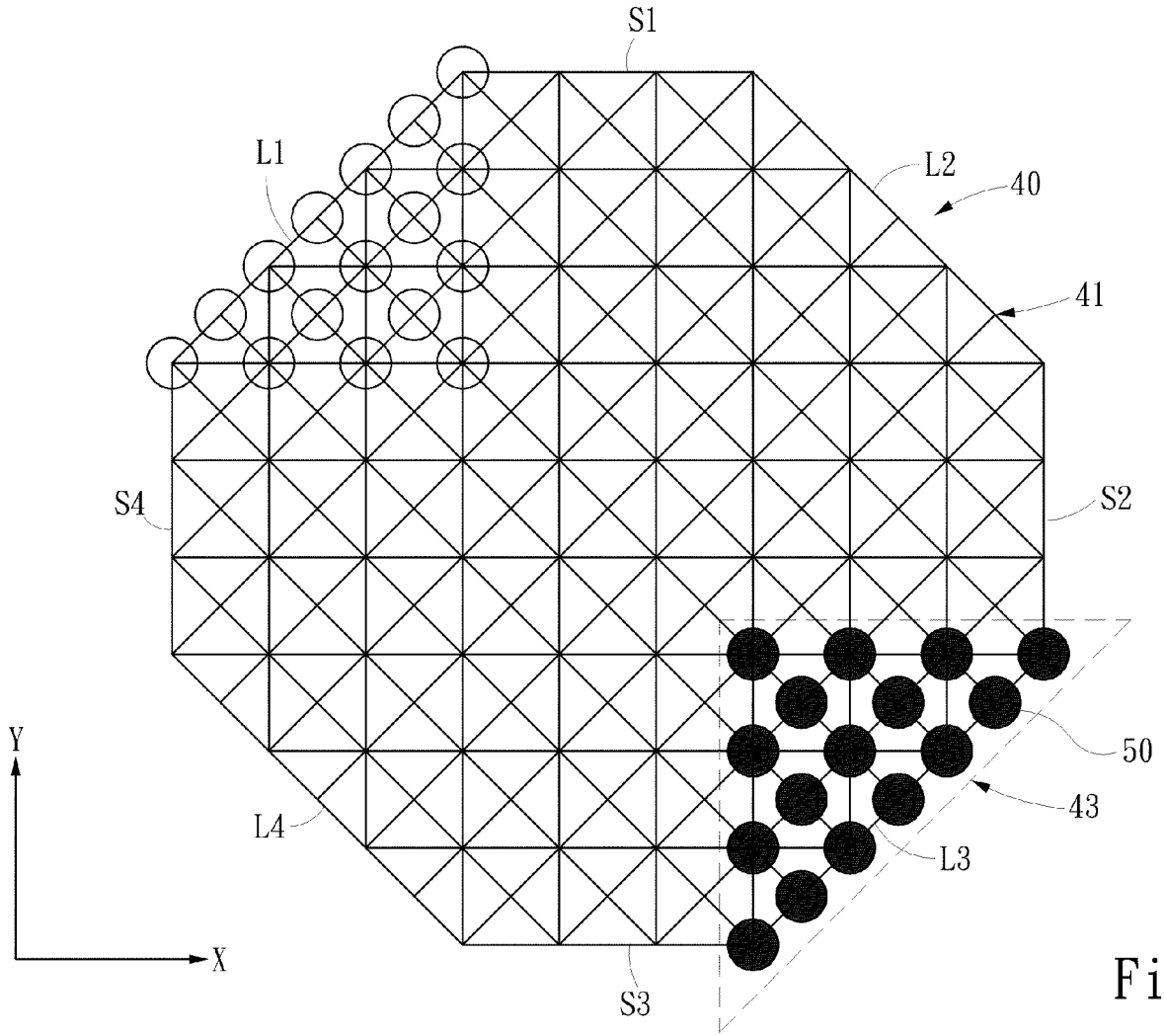
FIG. 4 is a schematic view of the chessboard of the invention.

Refer to FIG. 4 for a chessboard 40 and arrangements of pieces 50. The chessboard 40 is octagonal with four longer borders L1, L2, L3 and L4 not abutting one another, and four shorter second borders S1, S2, S3 and S4 interposed respectively between foresaid four longer borders L1, L2, L3 and L4. The chessboard 40 further has multiple longitudinal and transverse lines crossing one another to form points of intersection 41. The pieces 50 are positioned on the points of intersection 41 and movable along the lines to a neighboring point of intersection 41 that is not occupied. The lines are straight line formed in directions of X and Y axes, and diagonal straight lines forming a 45 degrees against X and Y axes. Each of the longer borders L1, L2, L3 and L4 has seven points of intersection 41 to hold seven pieces 50. And each of the shorter borders S1, S2, S3 and S4 has four points of intersection 41 to hold four pieces 50.

When the game is started initially, a base on the chessboard is allocated to a player (may be allocated by the game host 10 or selected by the player); the player arranges the pieces 50 on his/her base, and different types of pieces 50 are distributed to different players. The base of each player has one of the longer borders L1, L2, L3 and L4. Initially, each player lays sixteen pieces 50 from the selected longer border L1, L2, L3 or L4 towards the center of the chessboard 40, with each piece laid on one point of intersection 41 until an isosceles right triangle 43 is formed, and the longer borders become the bottom side of the triangle. In the event that there are two players playing the game, the preferable initial arrangement is to select two longer borders that are spaced from each other at a maximum distance for the two bases of the players, such as L1 and L3, or L2 and L4. Each player has the pieces 50 of a different type to differentiate each other, such as different colors, shapes or the like.

Figure 5A:
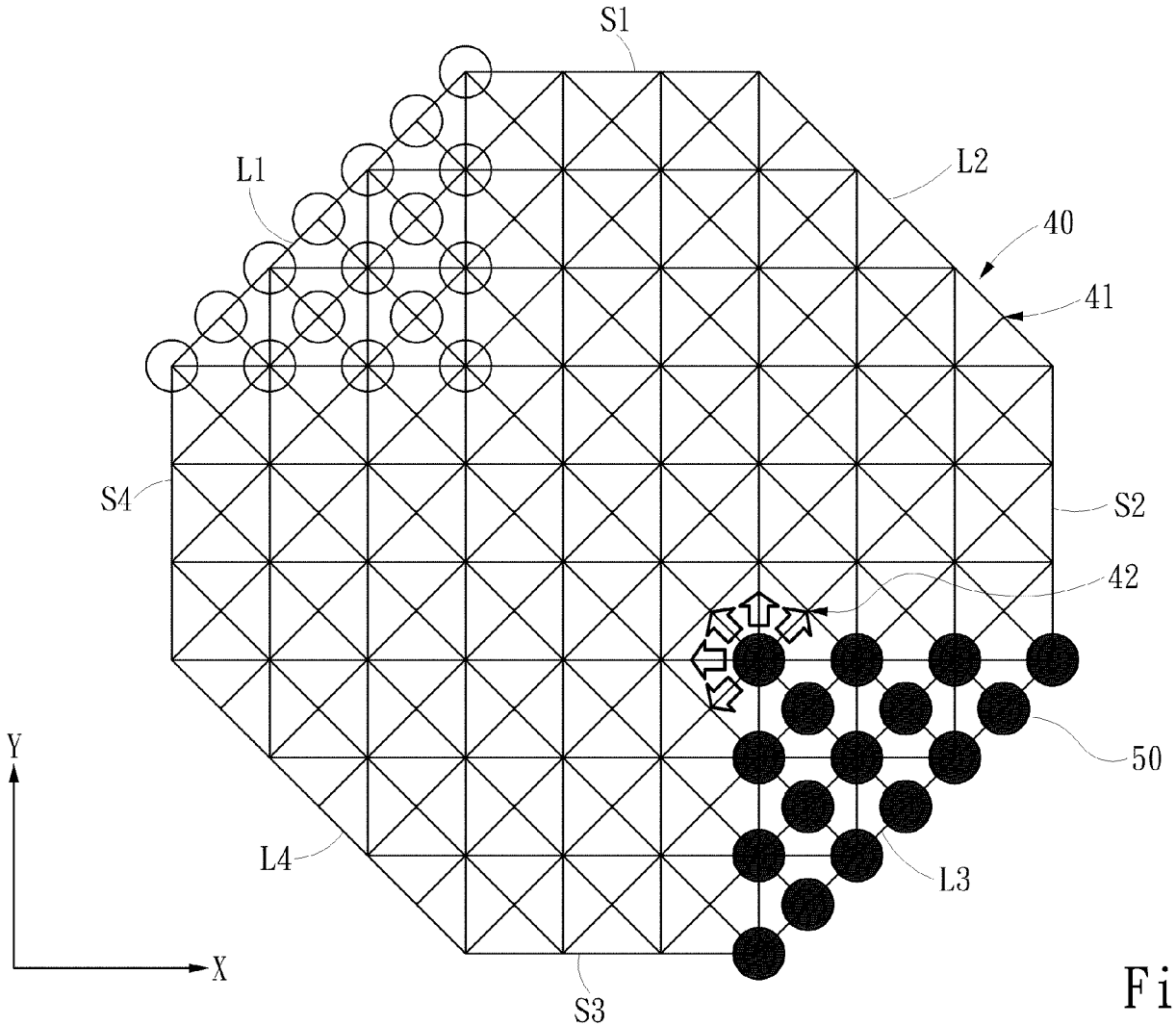
FIG. 5A is a schematic view of a playing example that allows moving of a piece on a straight line on the chessboard.
Figure 5B:
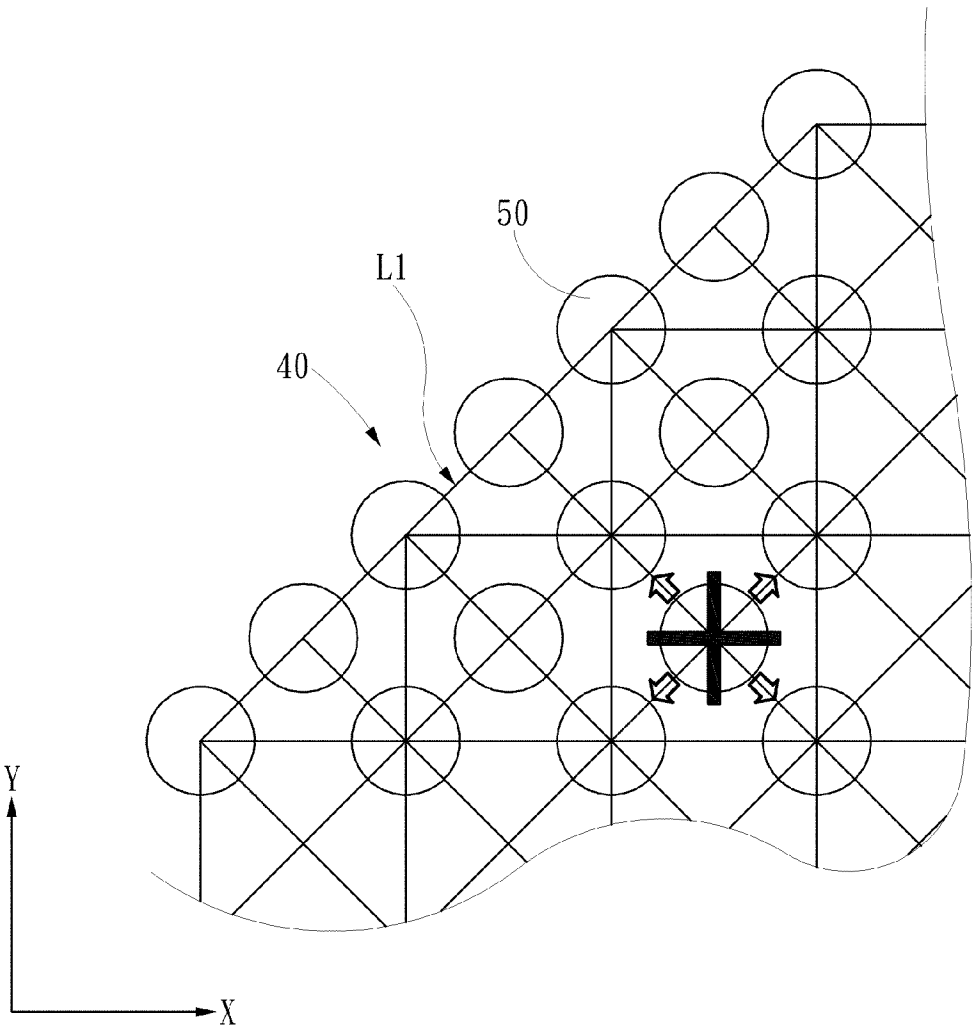
FIG. 5B is a schematic view of a playing example that does not allow moving of a piece on a straight line on the chessboard.
Figure 5C:
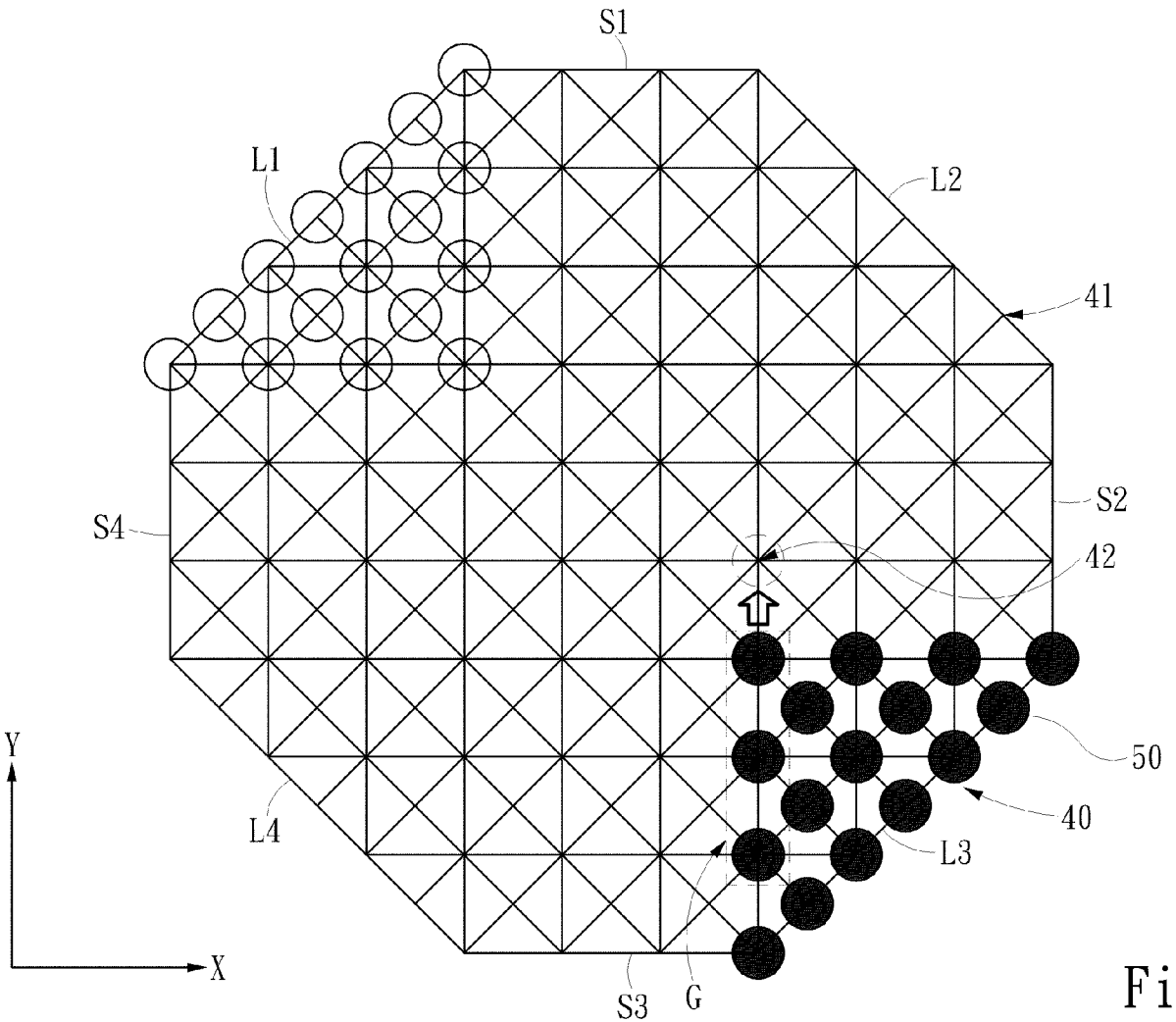
FIG. 5C is a schematic view of a playing example that allows moving of multiple pieces on a straight line on the chessboard at the same time.
Figure 5D:
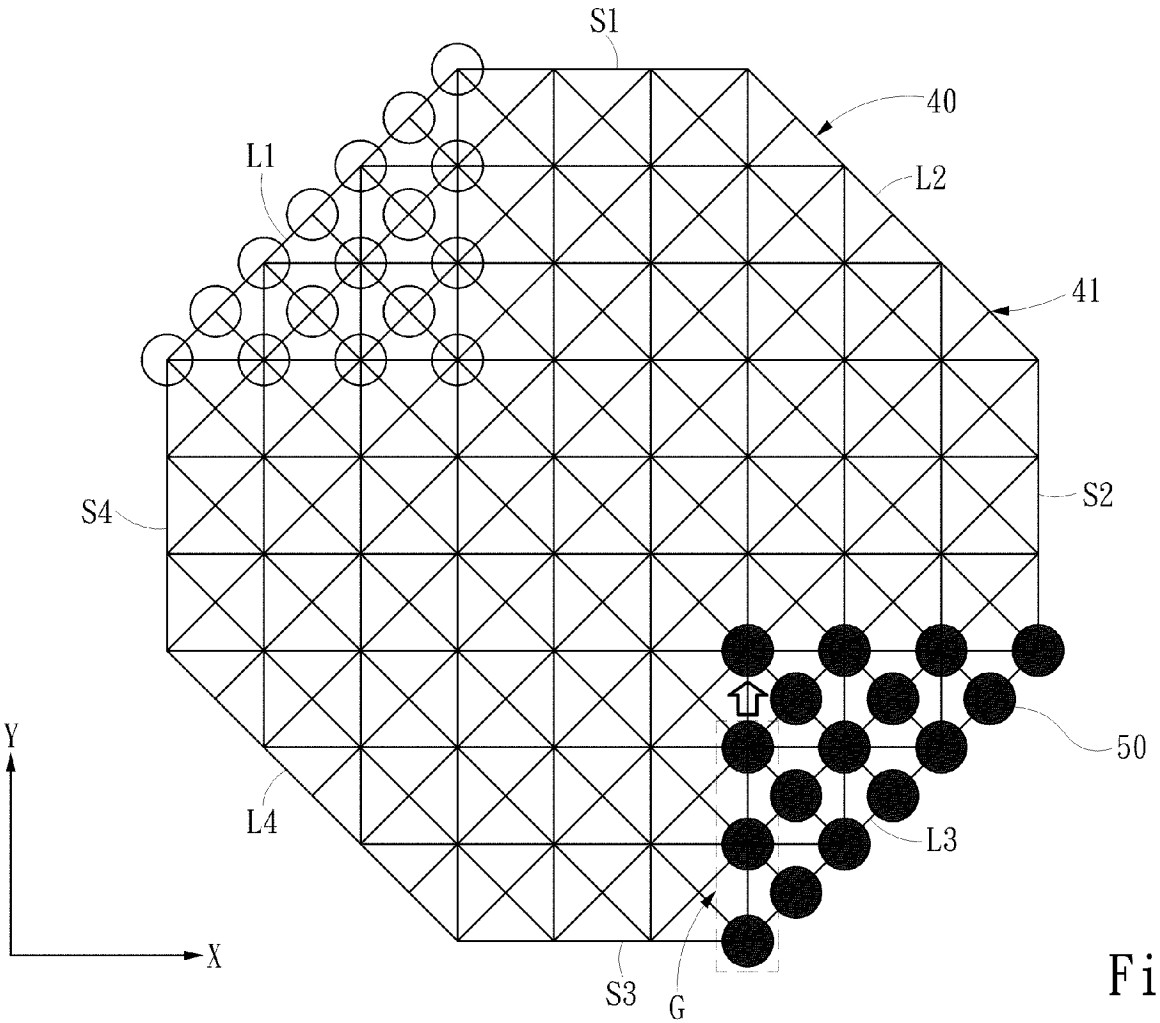
FIG. 5D is a schematic view of a playing example that does not allow moving of multiple pieces on a straight line on the chessboard at the same time.
Figure 5E:
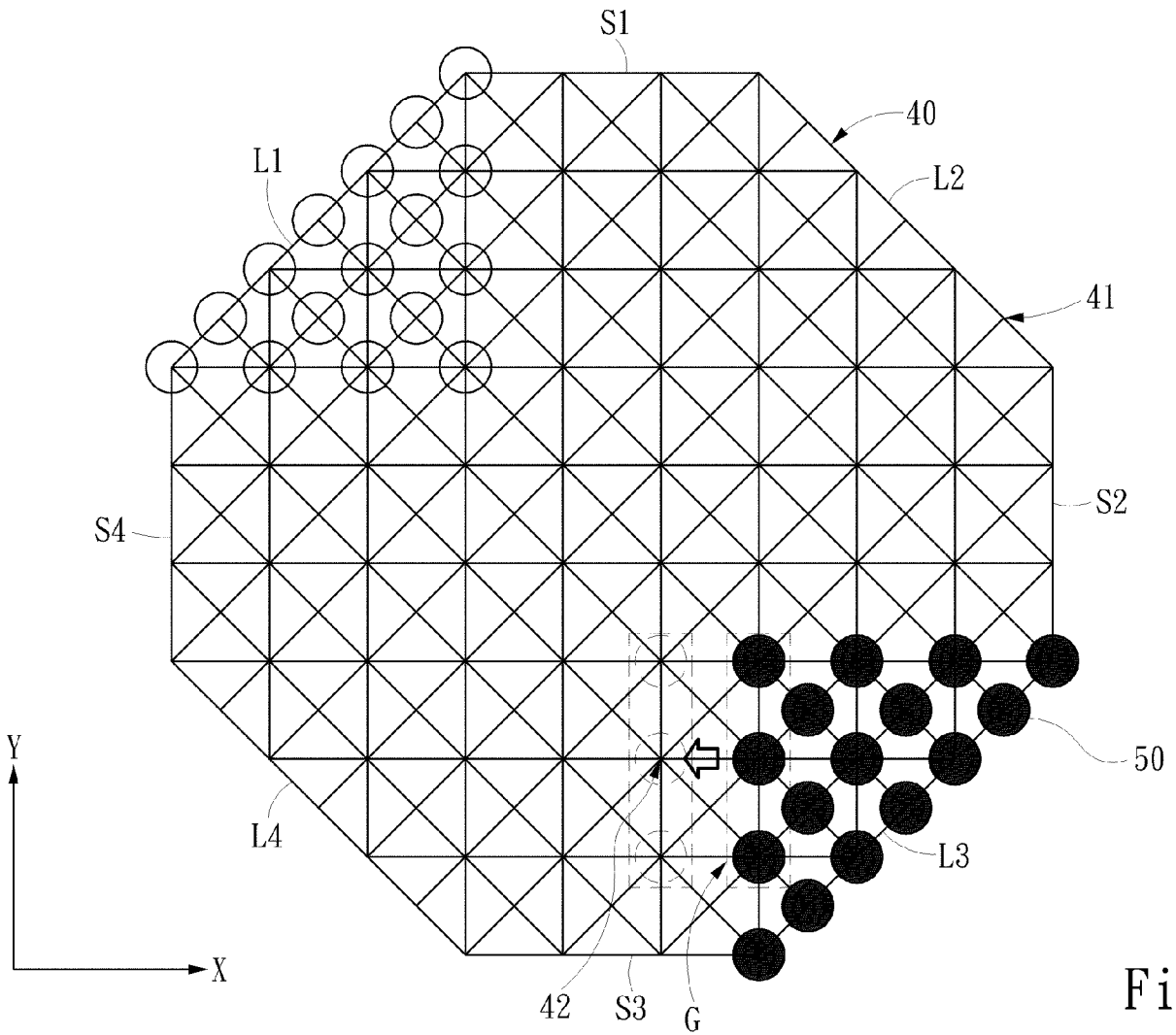
FIG. 5E is a schematic view of a playing example that allows moving of multiple pieces sidewards on the chessboard at the same time.
Figure 6A:
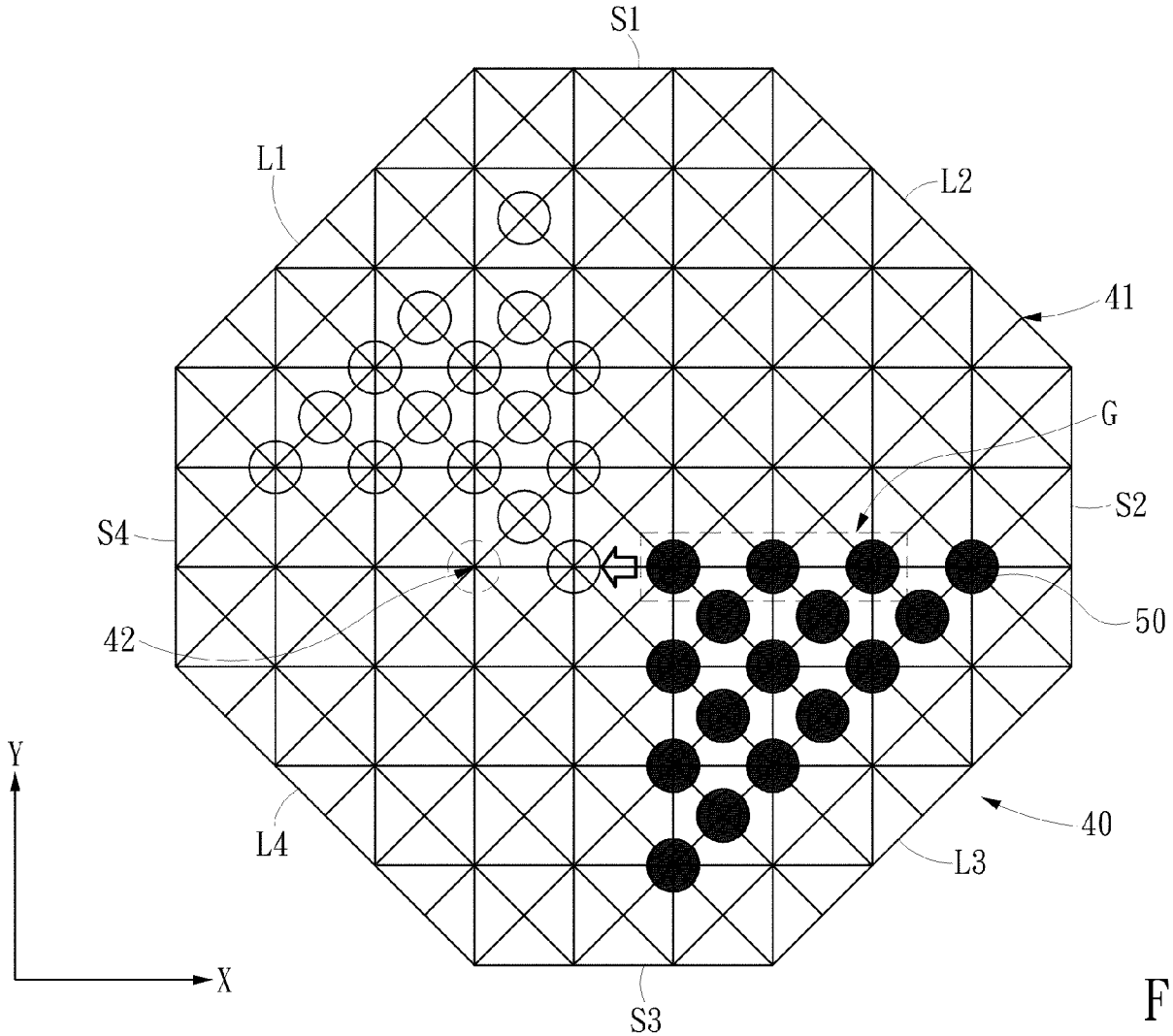
FIG. 6A is a schematic view of a playing example showing a piece group pushes an opponent's piece on a straight line.
Figure 6B:
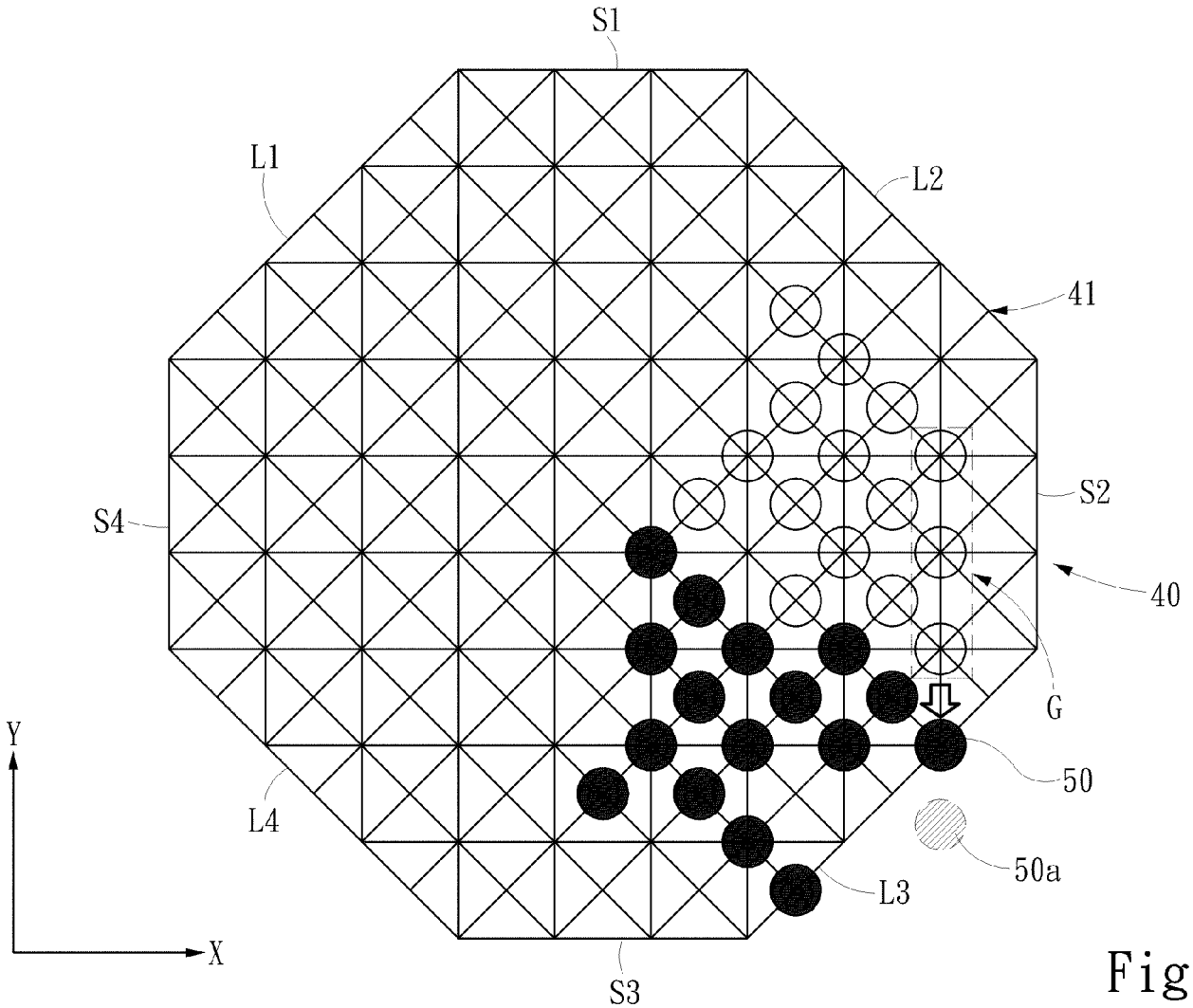
FIG. 6B is a schematic view of a playing example showing a piece group ejects an opponent's piece outside the chessboard.

The invention also provides a method of playing the shove board game. It includes procedures as follow:

allocating a base to each player, and laying pieces 50 on the base;

selecting one player as the active player, and proceeding a game by turn alternately (in one embodiment the active player is randomly selected by the game host 10 to start the game);

allowing the active player to select at least one piece 50, or two or maximum three adjacent pieces 50 on one line as an active moving-designated piece group G;

allowing a selected piece 50 or the selected active piece group G to move one step in one direction on one line (referring to FIGS. 5A and 5C) or sidewards in a same direction (referring to FIG. 5E);

moving a piece 50 of an opponent for one step on the same line in the moving direction of the active piece group G in a condition when the number of the opponent pieces are fewer than the active piece group G (the one step means another point of intersection 41 on the line closest to the point of intersection 41 of the moving first piece);

ejecting another piece 50*a* of a rival player from the border of the chessboard 40 and giving the ejected piece 50*a* to the active player (referring to FIG. 6B); and admitting a loser for any player who has remained pieces 50 fewer than one half of total pieces owned by the player when the game started (in an embodiment any player who has seven remained pieces 50 is a loser).

The method of game previously discussed can be realized through a shove board game program. Namely, game playing can be executed through program processing. However, it is not a limitation. The players also can play the game through a physical shove board game board. More embodiments of game playing according to the invention, such as with different number of players, are depicted below:

Method for Playing Games Including Three or More Players without Forming Teams:

For three or more players against one another without forming teams, one playing approach is giving the remained pieces 50 of the loser to the player who gains most pieces of the loser (in a preferred embodiment this may be accomplished by changing the remained pieces 50 of the loser to the type of pieces 50 of the player who gains the loser's pieces to facilitate differentiation).

Method for Playing Games with Four Players Grouped in Rival Teams:

The four players may be grouped in two rival teams, and each player plays by turn alternately. The active player is allowed to join the pieces 50 of (i.e. the teammate) to shove other pieces 50 of the rival team. The ejected pieces 50*a* during the joined period are the gains of the active player.

More specifics of game playing for four players grouped in two rival teams:

Two longer borders spaced from each other at a greatest distance such as L1 and L3 are allocated to one team as their bases, while another two longer borders spaced from each other at the greatest distance such as L2 and L4 are allocated to other team as their bases. Each player is given a different type of pieces 50. In another embodiment the bases may be assigned by the players freely as desired to increase amusement of the game. Other optional rules can be set as follow:

As previously discussed, the active player is allowed to join the pieces 50 of another player of the same team to shove other pieces 50 of the rival team. The ejected pieces 50 during the joined period are the gains of the active player;

the remained other pieces 50 of the loser are given to another player of the same team to continue the competition by teams; and any team with the remained pieces 50 fewer than one half of the total pieces owned by the team when the game started loses the game (for instance, for each team with two players owned total 32 pieces when the game started, if the remained pieces of any team is fifteen, that team is declared a loser), and the game ends.

Figure 5F:
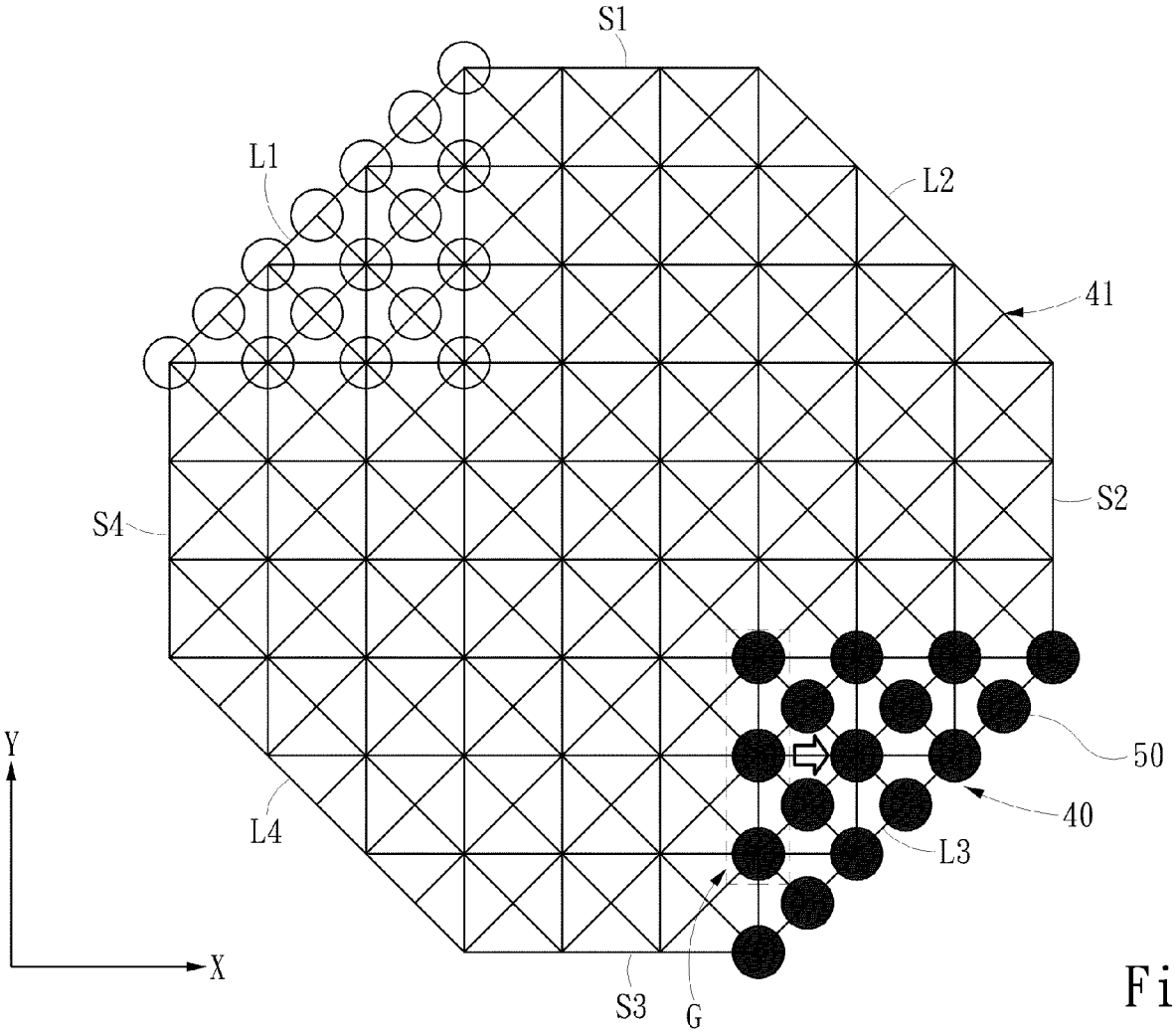
FIG. 5F is a schematic view of a playing example that does not allow moving of multiple pieces sidewards on the chessboard at the same time.
Figure 5G:
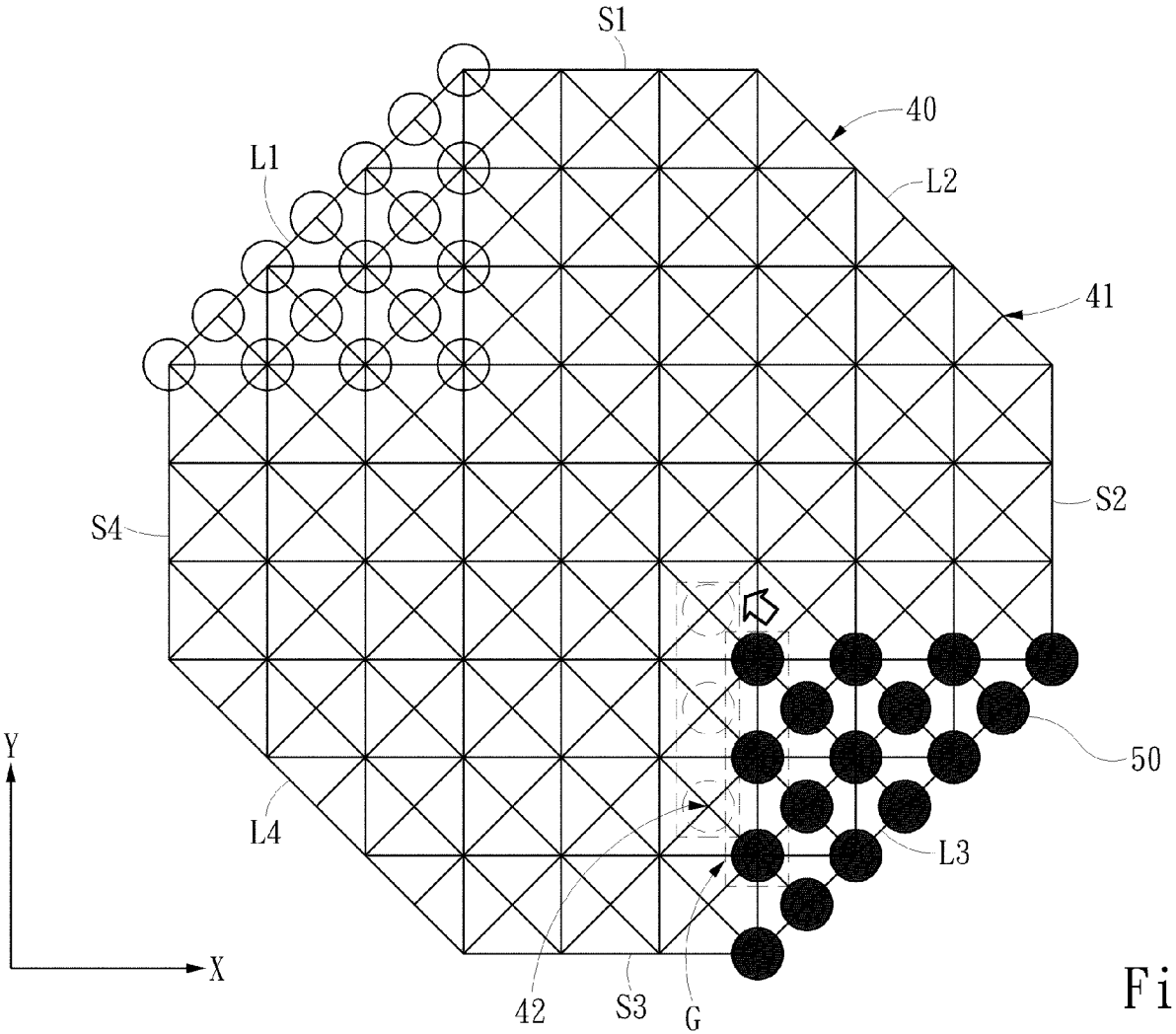
FIG. 5G is a schematic view of a playing example that allows moving of multiple pieces in a diagonal direction on the chessboard at the same time.

The shove board game system of the invention is executed through a shove board game program processed in the game host 10. The process procedures include:

displaying the chessboard 40 on the display device 20;

allocating a base to each player when the game starts (allocated by the system or selected by the player) and distributing a different type of pieces 50 to the base of different players;

allowing the players to play the game in turn alternately;

allowing an active player to select at least one piece 50 or a piece group G consisting of two or maximum three adjacent pieces on one line as an active moving-designated piece group G (called selected piece group G in short hereinafter);

allowing the selected piece group G to move one step on the same line in one direction (referring to FIG. 5C) or sidewards in another direction (referring to FIG. 5E), or diagonally in yet another direction (referring to FIG. 5G);

moving a piece of an opponent backwards on the same line in the moving direction of the selected piece group G in a condition in which the number of the pieces of an opponent are fewer than the selected piece group G (referring to FIG. 6A); and ejecting another piece 50*a* of other player from the border of the chessboard 40 and giving the ejected piece 50*a* to the active player (referring to FIG. 6B) as one gain-piece; and admitting a loser for any player who has remained pieces 50 fewer than one half of the total pieces owned by the player when the game started (in principle the number of remained pieces for deciding win or loss may be set separately, or settled by the participating players).

For a game with three or more players without forming teams, give the remained pieces 50 of the loser to the player who gains most pieces of the loser (in the event that two players have the same number of pieces 50 of the loser, the player who most recently gains the piece 50 of the loser claims the remained pieces 50 of the loser); then the remained two players continuously play the game until one of them becomes a loser, then the game ends. Namely, finally there is only one winner.

Figure 7A:
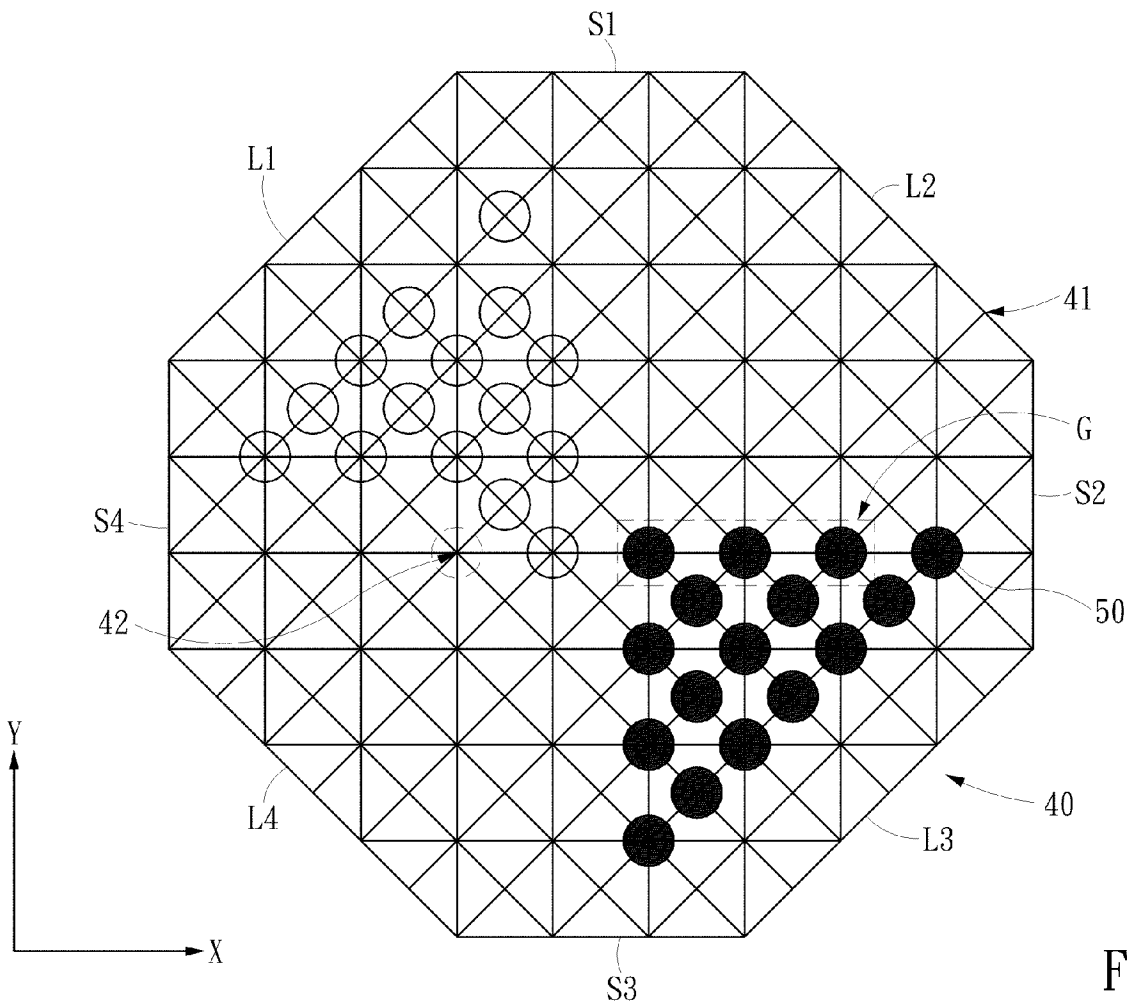
FIG. 7A is a schematic view of a playing example for selecting pieces on a chessboard to form a piece group through an input device.
Figure 7B:
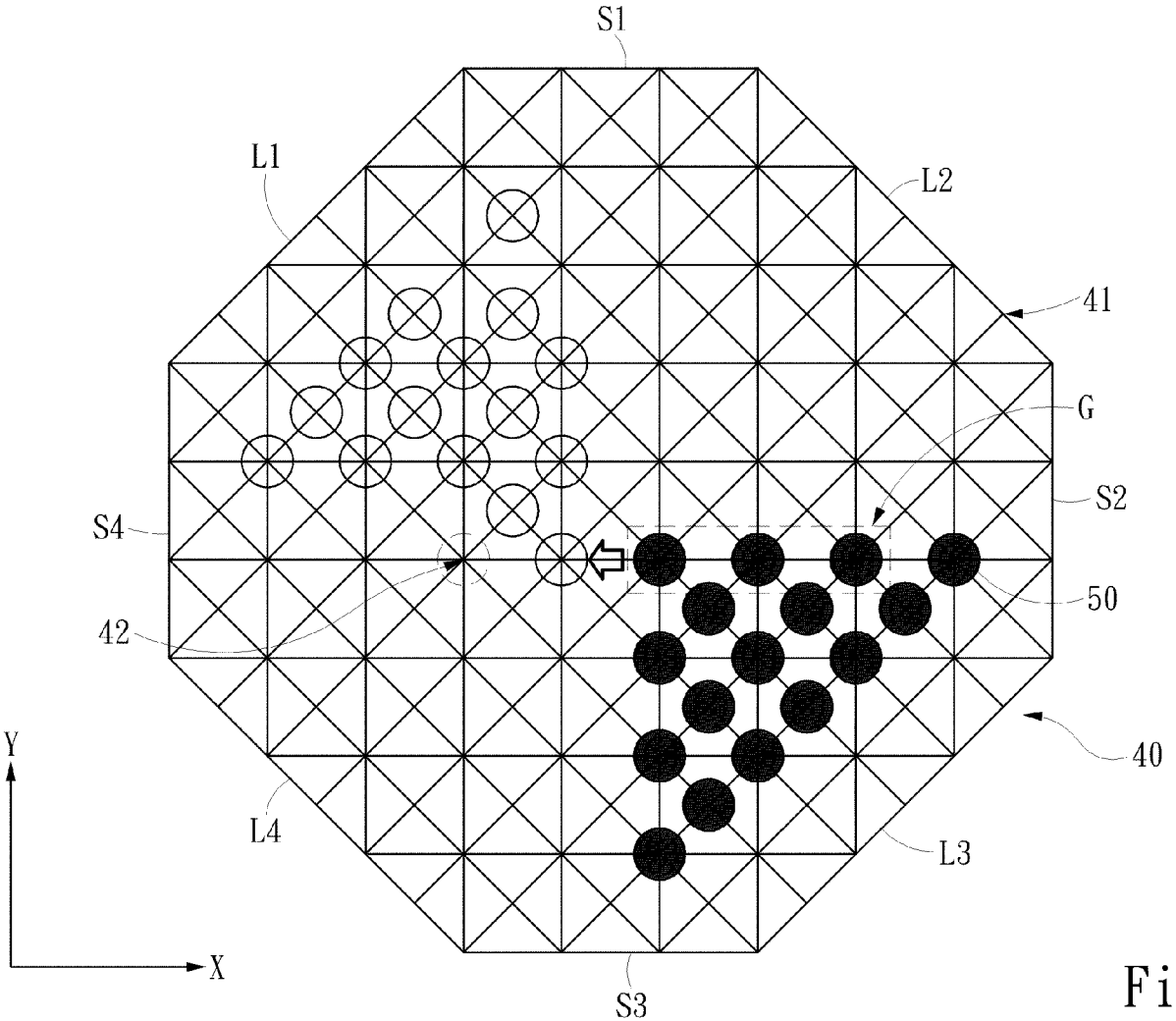
FIG. 7B is a schematic view of a playing example for designating a moving direction of a piece group through an input device.

Embodiments of Moving and Maneuvering the Pieces:

A graphic window operation system is taken as an example: When the active player wants to select the pieces 50 on the chessboard 40 for moving, according to an preferred implementing embodiment, the active player can select the pieces 50 to be moved by clicking to form a piece group G; then designate the moving direction of the piece group G. In practice, the player can form the piece group G (referring to FIG. 7A) on the chessboard 40 by clicking the input device (such as the right button of a mouse), then the cursor is dragged to indicate the moving direction of the selected piece group G (referring to the arrow shown in FIG. 7B), and the game can be maneuvered and proceeded.

Movements of pieces on the chessboard include straight moving, sideward moving and diagonal moving. One to three pieces can be moved each time. Examples are depicted as follow:

Straight Moving Example:

1. Move at least one piece 50 to another adjacent point of intersection 42 along the line of moving (referring to the arrow direction in FIG. 5A), the another point of intersection 42 must not be occupied by other piece 50. For instance, the intended moving conditions indicated by the arrows in FIG. 5B are not permitted.

2. On the moving line two to three adjacent pieces 50 can be moved for one step to the selected new point of intersection 42 at the same time (referring to the arrow direction in FIG. 5C); the selected new point of intersection 42 must not be occupied by other piece 50. For instance the intended moving condition indicated by the arrow in FIG. 5D is not permitted.

Sideward Moving Example:

Two to three adjacent pieces 50 on one line can be moved at the same time to adjacent new points of intersection 42 (referring to the arrow direction in FIG. 5E); any of the new points of intersections 42 must not be occupied by other piece. For instance, the intended moving condition indicated by the arrow in FIG. 5F is not permitted.

Diagonal Moving Example:

Two to three adjacent pieces 50 on one line can be moved at the same time to adjacent new points of intersection 42 (referring to the arrow direction in FIG. 5G); any of the new points of intersections 42 must not be occupied by other piece.

Joined Attack Permitted:

For a game with three or more players, the processing of the invention further includes a procedure for "joined attack permitted". The game system allows the active player to join the pieces 50 of another player (but no more than one another player) to shove the pieces of other player. For a game with four players grouped in two rival teams, the joined attack allows joining pieces of the teammates. The processing procedure of the "joined attack permitted" is as follow:

The active player is allowed to select his/her piece and adjacent pieces on the same line belong to another player (called ally) to form a piece group G of an "active side", with total piece number of the piece group G no more than three;

the game system issues a "join request" message to the ally and receives a "response message" from the ally; and if the "response message" is "agree", the active player can select the required pieces (including those owned by the active player and the ally) to form the piece group G of the "active side".

In an embodiment in practice, when the active player wants to move the pieces 50 which contain other pieces 50 belong to another player (i.e. the ally), the game system issues a "join request" message to the ally through the information window 11 to indicate the intended purpose of forming a joined piece group G, and waits for the "response message". For instance, the game system provides "agree" and "disagree" message options through the information window 11 to be selected by the ally. If the ally chooses the "response message" of "agree", the active player can organize the joined piece group G. On the other hand, if the allay chooses the "disagree" option, the game system sends such a message to the active player, and the joined piece group G cannot be formed, hence the active player has to select other piece group G anew.

Shoving the piece 50 of other player on the chessboard 40 is permitted only for the selected piece group G moving on the straight line, but not moving sidewards. The fundamental condition of shoving pieces 50 on the chessboard 40 is: "the pieces 50 on one line of a player to be shoved (called passive side in short) is permitted only when its number is fewer than that of the piece group G of the active side, and the pieces 50 of the passive side can be moved one step in the moving direction of the piece group F; If the number of pieces 50 of the active side and passive side is equal, no shove is permitted". Various types of combining conditions of the pieces 50 of the active side and passive side are shown in the following examples. To facilitate discussion, the pieces of different players are indicated by different symbols, and the piece group G of the active side is framed.

A. A Shove Board Game with Two Players:

1. The number of pieces 50 of the active side and passive side is equal, hence no shove is permitted:

Examples

○ ◎

[○ ○] ◎ ◎

[○ ○ ○] ◎ ◎ ◎

[○ ○ ○ ○] ◎ ◎ ◎, the upper limit of the piece group G of the active side is three;

[○ ○ ○] ◎ ◎ ◎ ◎, the passive side has three or more adjacent pieces.

2. The number of pieces 50 of the active side is greater than that of the passive side, moving one step is permitted:

Examples

[○ ○] ◎→ moving rightwards shown by the arrow for one step is permitted;

[○ ○ ○] ◎ ◎ → moving rightwards shown by the arrow for one step is permitted;

←○ [◎ ◎] moving leftwards shown by the arrow for one step is permitted;

←○ ○ [◎ ◎ ◎] moving leftwards shown by the arrow for one step is permitted.

B. A Shove Board Game with Three or More Players:

If no "joined attack" exists, when any piece group consisting of one type of pieces that has a greater number than that of any other individual type of pieces, the other types of pieces may be shoved (this also is called the principle of "regular army" is superior to "irregular army").

Examples

○ ○ ○ ◎ ◎ * → three adjacent pieces of the same type ○ are on one line that are greater in number than any other piece type ◎ or *, thus ○ pieces are permitted to move rightwards shown by the arrow for one step to shove ◎ or * pieces at the same time;

○ ○ ○ ◎ ◎ * * → three adjacent pieces of the same type ○ are on one line that are greater in number than any other piece type ◎ or *, thus ○ pieces are permitted to move rightwards shown by the arrow for one step to shove ◎ or * pieces at the same time;

○ ○ ○ ◎ ◎ * * → three adjacent pieces of the same type ○ are on one line that are greater in number than any other piece type ◎ or *, thus ○ pieces are permitted to move rightwards shown by the arrow for one step to shove ◎ or * pieces at the same time;

○ ○ ○ ◎ ◎ * * * → three adjacent pieces of the same type ○ are on one line that are greater in number than the piece type ◎, but not greater than another piece type *, thus moving ○ pieces is not permitted.

C. A Shove Board Game with Three or More Players in a "Joined Attack Permitted" Condition:

Examples

○ ○ [◎ ◎ ※] ← pieces 50 are on the same line on the chessboard 40; the active player (owner of pieces ◎) is allowed to select pieces "◎ ◎ ※" to form a piece group G and drag the cursor to move the piece group G in the arrow direction; the game system issues a "join request" message to the player who owns piece ※ whether the "join request" is consented to shove rival pieces ○ ○; if consent received, pieces ◎ ◎ ※ are joined together to shove the rival pieces ○ ○ leftwards for one step; if one of the rival pieces ○ ○ is ejected outside the border of the chessboard, the ejected ○ piece is gained by the active player (owner of pieces ◎).

However, the join agreement is not permanent. The players can make a different agreement for each round of game as desired. Thus in one round of game, piece ※ may join another piece ◎ to shove yet another piece ○; but in another round of game, piece ※ may join yet another piece ○ to shove another piece ◎.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method of operating a shove board game on a shove board game system, the shove board game system including an electronic game host device to process a shove board game program, a display device communicating with the game host device, and an input device communicating with the game host device to receive operations of the players to proceed the shove board game, the method comprising the steps of:

displaying a chessboard and pieces on the display device, the chessboard being octagonal and having four longer borders not adjacent to one another, four shorter borders interposed respectively between the four longer borders, and a plurality of crossed lines to form points of intersection to hold the pieces which are movable along the lines to another adjacent point of intersection, the lines being straight lines formed in directions of X and Y axes and also in diagonal directions at an angle of 45 degrees against the X and Y axes;

providing bases to participating players by the game host device to hold each player's own pieces;

selecting an active player and taking turns among the players to proceed the shove board game;

allowing the active player to select at least one, or two or maximum three adjacent pieces on one line as an active moving-designated piece group by the input device, and inputting the selection to the game host device;

allowing the selected one piece or piece group to move one step in one direction of the one line or towards one side by the game host device;

moving an opponent's pieces in the moving direction of the moving-designated piece group by the input device in the event that the number of the opponent's pieces on the one line is fewer than that of the moving-designated piece group, and displaying the moving condition of the pieces on the display device;

giving the pieces ejected outside the borders of the chessboard to the active player by the game host device; and the game host device admitting a loser whose remaining pieces are fewer than one half of total pieces owned when the shove board game started.

2. The method of claim 1, wherein each of the longer borders has seven points of intersection for holding the pieces and each of the shorter borders has four points of intersection for holding other pieces.

3. The method of claim 1, wherein each base has initially sixteen pieces arranged from one of the longer borders towards the center thereof and laid on the points of intersection until an isosceles right triangle is formed, and the longer border becomes the bottom side of the isosceles right triangle.

4. The method of claim 1, wherein the number of the pieces in the piece group is no more than three.

5. The method of claim 1 further including allowing the active player to join the pieces of another player to shove other pieces of other players by the game host device.

6. The method of claim 1 further including the game host device giving the remaining pieces of the loser to another player who has gained most of the pieces of the loser in the shove board game which has three or more players.

7. The method of claim 1 further including:

allowing four players to group in two rival teams and each player playing by turn alternately by the game host device;

the game host device allowing the active player to join the pieces of another player of the same team to shove other pieces of the rival team, the ejected pieces during the joined period being the gains of the active player;

giving the remaining pieces of the loser to another player of the same team thereof by the game host device; and the game host device admitting a loser for the team whose remaining pieces are less than one half of total pieces owned by the team when the game started.

8. The method of claim 1, wherein the game host device is a server linking to a network, the display device being a client computer of the server, the input device being located on the client computer.

9. The method of claim 1, wherein the game host device is a personal computer, a notebook computer or an electronic device having program processing capability to execute the shove board game program.

10. The method of claim 1, wherein the display device is a touch screen.

* * * * *